US006021836A

United States Patent [19]

Schmitz

[11] Patent Number: 6,021,836

[45] Date of Patent: Feb. 8, 2000

[54] JOINT ARM FOR A JOINT ARM AWNING AND METHOD OF PRODUCING THE SAME

[75] Inventor: Justus Schmitz, Emsdetten, Germany

[73] Assignee: Schmitz-Werke GmbH + Co., Emsdetten, Germany

[21] Appl. No.: 09/144,848

[22] Filed: Sep. 1, 1998

[30] Foreign Application Priority Data

Sep. 18, 1997 [DE] Germany ..... 197 41 111

[51] Int. Cl.[7] ..... E04F 10/06

[52] U.S. Cl. ..... 160/70; 160/79

[58] Field of Search ..... 160/79, 78, 69, 160/70, 83.1, 405, 66, 22; 135/88.11, 88.12; 16/DIG. 42, 221; 29/11

[56] References Cited

U.S. PATENT DOCUMENTS

| | | | |
|---|---|---|---|
| 476,521 | 6/1892 | Corscaden | 16/221 X |
| 1,406,727 | 9/1922 | Douglas | 16/DIG. 42 X |
| 1,772,560 | 8/1930 | Soss | 29/11 |
| 1,801,559 | 4/1931 | Kellogg | 29/11 |
| 3,991,805 | 11/1976 | Clauss | 160/22 |
| 4,214,621 | 7/1980 | Wessels et al. | 160/66 |

FOREIGN PATENT DOCUMENTS

| | | |
|---|---|---|
| 42 00 564 | 7/1993 | Germany . |
| 296 18 641 | 2/1997 | Germany . |

*Primary Examiner*—David M. Purol
*Attorney, Agent, or Firm*—Browdy and Neimark

[57] ABSTRACT

In a joint arm for a joint arm awning, which comprises a first joint arm part and a second joint arm part which consist of a hollow section of sheet metal and are connected with each other by a pivot joint, it is provided, with a view to creating the possibility of rapid and cost-effective manufacture, that the extremities, on the side of the joint, of the joint arm parts are flattened and bent to be of approximately circular cross-sectional shape, forming at least one knuckle eye.

4 Claims, 5 Drawing Sheets

FIG. 2a
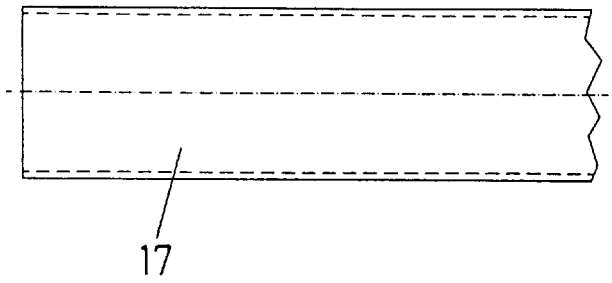
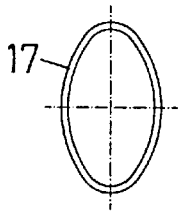
FIG. 2c
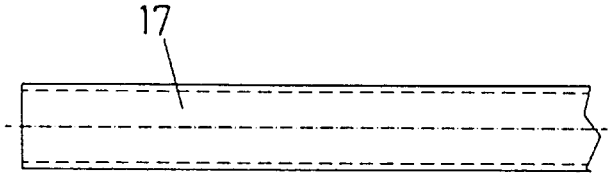
FIG. 2b
FIG. 3a
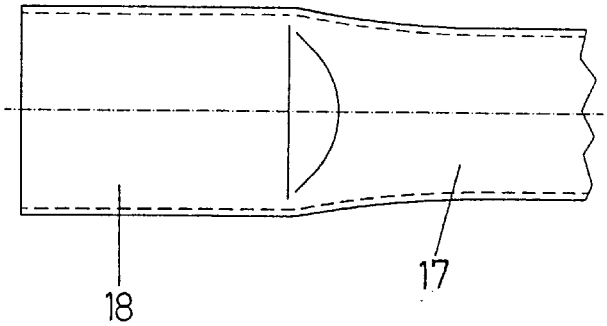
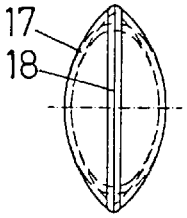
FIG. 3c
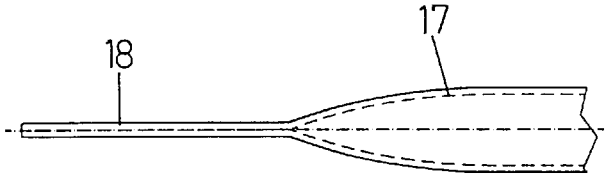
FIG. 3b FIG. 4a
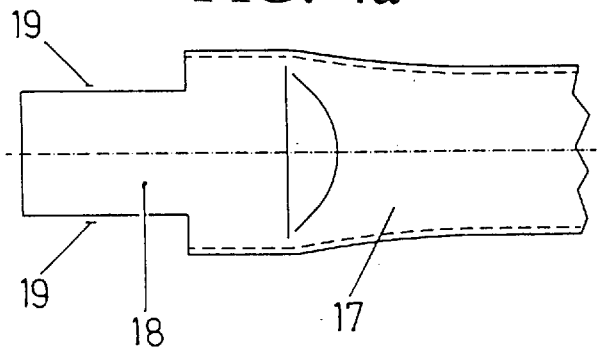
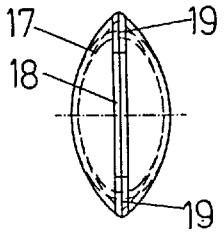
FIG. 4c
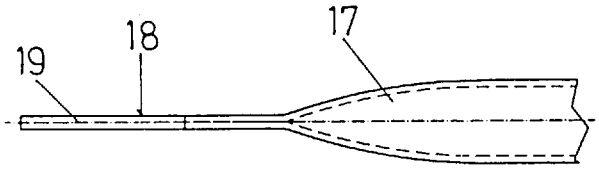
FIG. 4b
FIG. 5a
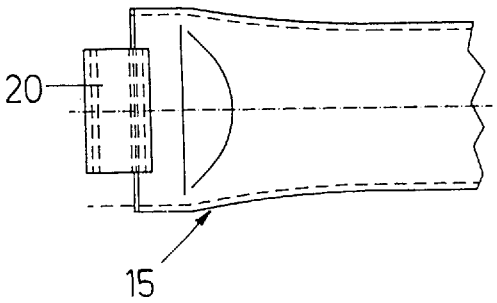
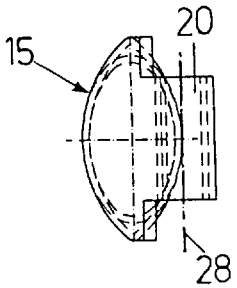
FIG. 5c
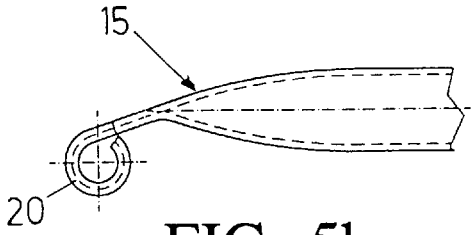
FIG. 5b FIG. 6a
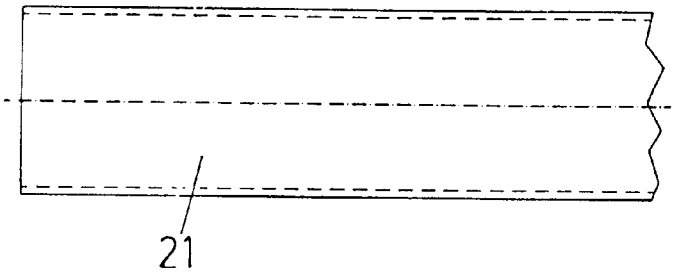
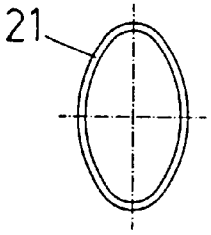
FIG. 6c
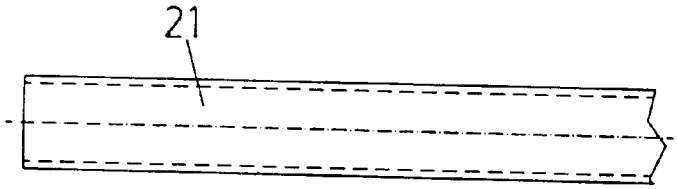
FIG. 6b
FIG. 7a
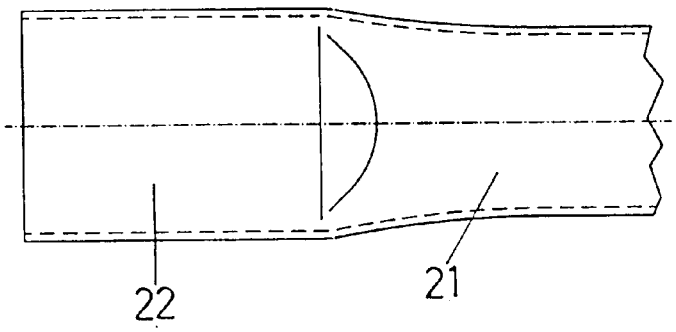
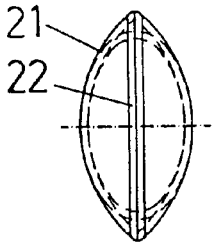
FIG. 7c
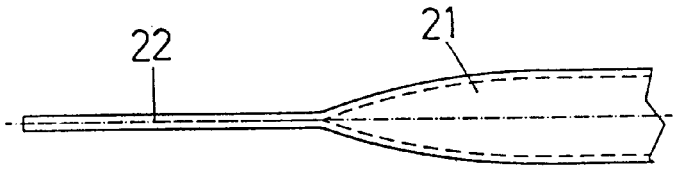
FIG. 7b FIG. 8a
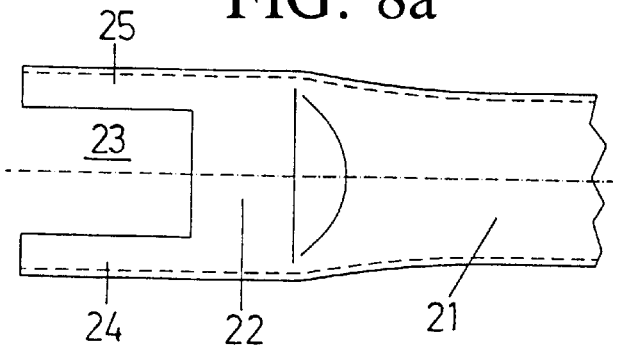
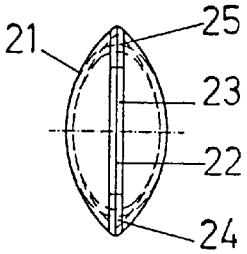
FIG. 8c
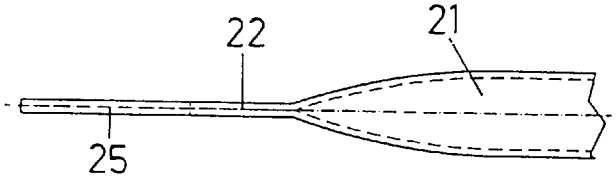
FIG. 8b
FIG. 9a
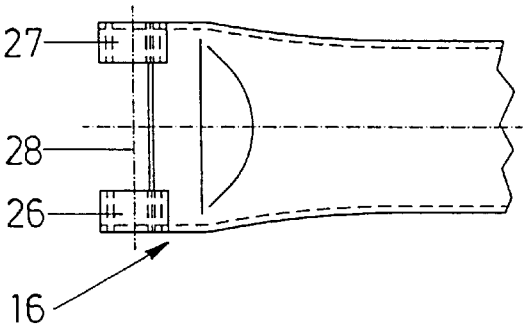
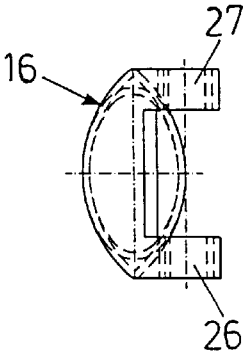
FIG. 9c
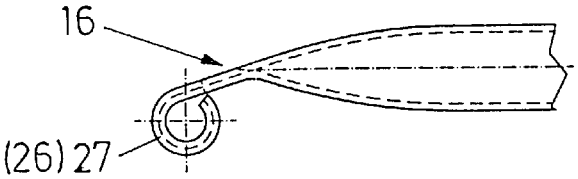
FIG. 9b

JOINT ARM FOR A JOINT ARM AWNING AND METHOD OF PRODUCING THE SAME

BACKGROUND OF THE INVENTION

1. Field of the Invention

The invention relates to a joint arm for a joint arm awning and a method of producing a joint arm which comprises a first joint arm part and a second joint arm part which consist of a hollow section of sheet metal and are united by a pivot joint.

2. Background Art

Conventionally, the pivotjoints are formed by special steel elements which are inserted in the hollow sections and united with same, for instance by screws, which implies special manufacturing and assembling requirements.

SUMMARY OF THE INVENTION

It is an object of the invention to embody and manufacture a joint arm with a design which can be put into practice at a low cost.

According to the invention, this object is attained in that the extremities, on the side of the joint, of the joint arm parts are flattened and bent to be of approximately circular cross-sectional shape, forming at least one knuckle eye for a joint bolt.

In this case, it can in particular be provided that for two knuckle eyes to be formed on the upper and lower edge, the flattened sheet metal portion located therebetween is punched out, or that for a central knuckle eye to be formed, rectangles are punched out on the edges of the flattened sheet metal portion. This helps create joint positively engage so that the central knuckle eye is aligned between the two outer knuckle eyes to permit a bolt to be inserted, to form a pivot joint.

The invention also relates to a method according to which it is provided that, starting from a hollow section, for instance a box-type or elliptic hollow section, a portion on the side of the extremity of the hollow section is flattened, and punched out, corresponding to the positioning of the knuckle eyes to be provided, and that the remaining sheet metal tongues are bent to be of approximately circular cross-sectional shape, forming the knuckle eyes.

Details of the invention will become apparent from the ensuing description of a preferred exemplary embodiment, taken in conjunction with the drawing.

BRIEF DESCRIPTION OF THE DRAWING

FIG. 2*a* is a side view, FIG. 2*b* is a plan view, and FIG. 2*c* is a cross-sectional view of the first joint arm part in the initial state during manufacture;

FIGS. 3*a* to 3*c*, FIGS. 4*a* to 4*c*, FIGS. 5*a* to 5*c* are illustrations corresponding to FIGS. 2*a* to 2*c* during three successive manufacturing procedure steps; and FIG. 6 to FIG. 9 are illustrations corresponding to FIGS. 2 to 5 of the second joint arm part.

DESCRIPTION OF THE PREFERRED EMBODIMENT

Figure 1:
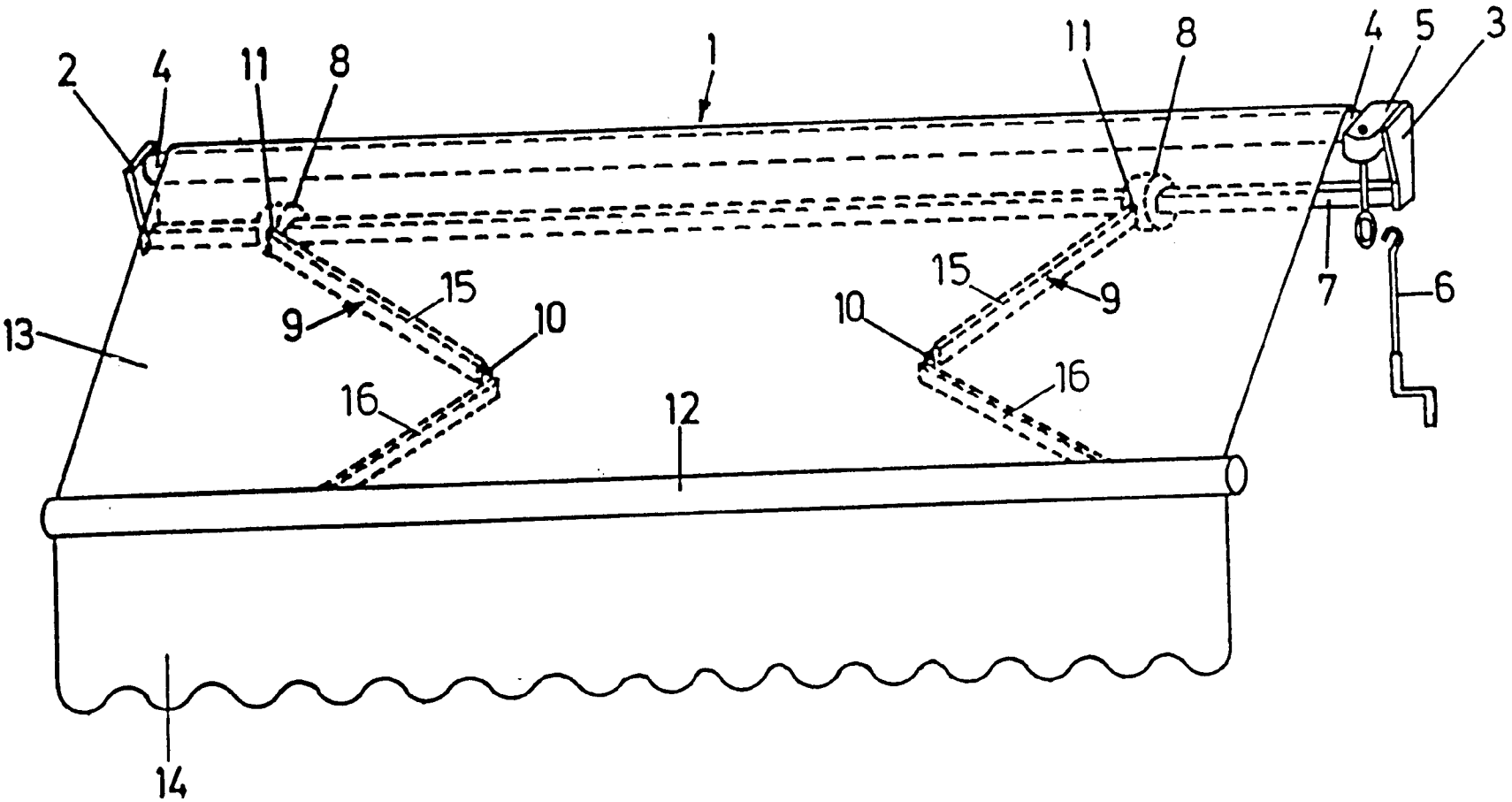
FIG. 1 is a diagrammatic, perspective view of a joint arm awning having two joint arms.

The awning seen in the drawing possesses a support device 1 to be fixed to the wall of a house or the like and equipped with a wind-up shaft 4 which is rotatably engaged bearing plates 2, 3. As conventional, this wind-up shaft 4 is rotatable by a self-locking mechanism 5 according to the illustration of FIG. 1, this mechanism 5 again being actuated by a demountable hang-up crank rod 6. Of course—and as generally known—an electric motor drive, a strap mechanism or the like may be employed instead of the mechanism 5 and the crank rod 6. Mounted between the bearing plates 2 and 3 is a support pipe 7 of square cross-sectional shape as part of the support device 1, to which joint arms 9 of so-called lazy tongs design are fixed each by means of a device 8 for the support and the adjustment of the angle of inclination. These joint arms 9 are divided centrally and provided with a pivot joint 10 that has a vertical axis. The joint arms 9 are articulated to the corresponding device 8, each by means of a pivotjoint 11 of the same type, which cannot be seen in the drawing. The joint arms 9 are articulated to a drop-out pipe 12 by means of a corresponding pivot joint so that the drop-out pipe 12 can be displaced in a plane common to it and the wind-up shaft 4, but cannot perform any motions perpendicular to this plane.

A rectangular awning fabric 13 is fixed to the wind-up shaft 4 and can be rolled on or off the shaft 4 by the described rotations of this shaft 4. Furthermore, the awning fabric 13 is fixed to the drop-out pipe 12 in a manner generally known. A downward fringe 14 is fastened to the drop-out pipe 12.

Each joint arm 9 comprises a first inner joint arm part 15 and a second outer joint arm part 16 which are united by the mentioned pivot joint 10.

Each joint arm part 15, 16 consists of a hollow section of sheet metal of approximately oval cross-sectional shape in the embodiment, the formation and production of the pivot joint 10 being explained in the following in connection with FIGS. 2 to 9:

FIG. 2 illustrates the hollow section of sheet metal from which the first joint arm part 15 is produced. In a first procedure step seen in FIG. 3, the extremity, on the side of the joint, of the hollow section 17 is flattened, forming a flat portion 18.

In the procedure step seen in FIG. 4, the flat portion 18 is provided with punched out rectangles 19 on its edges, and in the procedure step seen in FIG. 5, the part of the flattened portion 18 that remains after the punching job is bent to be of approximately circular cross-sectional shape, forming a knuckle eye 20, as seen in particular in FIG. 5*b*.

FIGS. 6 to 9 illustrate the production of the second joint arm part 16, starting from a hollow section 21 as seen in FIG. 6. The extremity, on the side of the joint, of the hollow section 21 is flattened, forming a flat portion 22, which is illustrated in FIG. 7.

The procedure step seen in FIG. 8 consists in the flat portion 22 being provided centrally with a punched out rectangle 23 so that two tongues 24, 25 remain which are bent to be of approximately circular cross-sectional shape, forming knuckle eyes 26, 27, which is illustrated in particular in FIG. 9.

A combination of FIG. 5*a* and FIG. 9*a* shows that the knuckle eye 20 of the first joint arm part 15 can be placed in between the knuckle eyes 26, 27 of the second joint arm part 16 in alignment with same so that a bolt 28, of which only the central longitudinal axis is shown, can be passed through and fixed by rivet or screw for a joint to be formed.

This is a simple, rapid and—above all—cost-effective way of putting the pivotjoint 10 into practice.

What is claimed is:

1. A joint arm for a joint arm awning comprising;

a first joint arm part (15) and a second joint arm part (16) which consist of a hollow section of sheet metal and which are connected to each other by a pivot joint;

wherein, ends of said hollow section of said first joint arm part and said second joint arm part are flattened and bent to be approximately circular in cross-sectional shape to form at least one knuckle eye (20, 26, 27), and wherein, when each said knuckle eye is coaxially aligned with a pivot pin said pivot joint is produced.

2. Joint arm according to claim 1, wherein two knuckle eyes (26, 27) are formed on tongues (24,25) of said first joint arm part (15) after a flattened sheet metal portion (23) located between said tongues (24, 25) is punched out.

3. A joint arm according to claim 1, wherein a central knuckle eye (20) is formed on said second joint arm part (16) after rectangles are punched out on edges of a flattened sheet metal portion (18).

4. A method of producing a joint arm for a joint arm awning, the joint arm comprising a first joint arm part and a second joint arm part each initially consisting of a hollow section of sheet metal, said first and second joint arm parts being connected to each other by a pivot joint, said method comprising the steps of:

flattening an end of each of said first joint arm part and said second joint arm part to form a flattened sheet metal portion on said end;

forming two tongues on said first joint arm part by punching out a central portion of said flattened sheet metal portion;

thereafter bending each of said two tongues on said first joint arm part to be approximately circular in cross-sectional shape to form two knuckle eyes;

punching out opposite edges of said flattened sheet metal portion on said second joint arm part to form a central tongue;

thereafter bending said central tongue on said second joint arm part to be approximately circular in cross-sectional shape to form a central knuckle eye;

aligning axes of said two knuckle eyes on said first joint arm part and said central knuckle on said second joint arm part to be coaxial; and engaging a pivot pin through the aligned knuckle eyes to produce said pivot joint.

* * * * *